United States Patent [19]

Schoene

[11] Patent Number: 4,713,580

[45] Date of Patent: Dec. 15, 1987

[54] SEALING STRUCTURE FOR METAL VAPOR ARC DISCHARGE LAMPS

[75] Inventor: Carl M. Schoene, North Andover, Mass.

[73] Assignee: GTE Products Corporation, Danvers, Mass.

[21] Appl. No.: 944,690

[22] Filed: Dec. 19, 1986

[51] Int. Cl.[4] ..... H01J 61/36; H01J 9/26

[52] U.S. Cl. ..... 313/624; 313/634; 445/26; 445/44

[58] Field of Search ..... 313/624, 625, 623, 634; 445/26, 44

[56] References Cited

U.S. PATENT DOCUMENTS 4,034,252 7/1977 McVey ..... 313/625

FOREIGN PATENT DOCUMENTS 0064175 5/1977 Japan ..... 313/625

2156147 10/1985 United Kingdom ..... 445/26

*Primary Examiner*—Palmer C. DeMeo

*Attorney, Agent, or Firm*—Martha A. Finnegan

[57] ABSTRACT

A seal button comprising a first circular portion having a diameter approximately equal to the outside diameter of the arc tube, the first circular portion having a groove extending across the diameter of the first circular portion, the groove having a depth greater than or approximately equal to the thickness of the first circular portion; and a second circular portion concentric with and extending from the first circular portion, the second circular portion having a diameter of appropriate length for being inserted into an end of the arc tube; the seal button having an opening extending axially through the approximate center thereof, the opening being configured for receiving the electrical feedthrough portion of an electrode assembly.

10 Claims, 13 Drawing Figures

SEALING STRUCTURE FOR METAL VAPOR ARC DISCHARGE LAMPS

BACKGROUND OF THE INVENTION

This invention relates to metal vapor arc discharge lamps. More particularly, this invention is concerned with an end sealing structure for the arc tube of a metal vapor arc discharge lamp.

The sealing of high operating temperature sodium resistant arc tubes for use in metal vapor arc discharge lamps, such as, for example, high pressure sodium lamps, is a continually changing and improving art. The driving forces for such changes include lower cost, improved reliability, easier assembly and reduced shrinkage of product. Several different designs and modifications of these designs are presently in use. Three of these designs are illustrated in FIG. 1(*a–c*). These general designs can be adapted for use with an electrode assembly 9 employing either a tube or a wire electrical feed-through. Each modification has specific advantages and disadvantages.

The monolithic design (FIG. 1*a*) has been extensively used because of its minimal interior seal material exposure associated with only one seal region. It has the disadvantage though of requiring a more complex and costly arc tube, because the insert buttons required for making the two monolithic ends, must be precisely aligned and sintered in place.

The hat (FIG. 1*b*) and disk (FIG. 1*c*) seals take advantage of a less expensive straight tube construction. Unfortunately, while having cost advantages, they introduce other disadvantages. For example, these constructions require sealing of two regions, an inner and an outer annulus, which requires supplying seal material to the two regions.

The existing hat seal design (FIG. 1*b*) makes use of two different sealing rings 13, 14. Reference to FIG. 1*b* shows that the outer ring 14 is of a large diameter with a small cross-section; this is a fragile and easily broken piece. During assembly this frail construction is more prone to breakage with handling. More extensive handling is required to align the seal ring 14 on the hat 15 and then properly seat the hat into the arc tube 16. It has also been found that although the ring may appear to be intact, when it is heated near its melting point the ring can break from the added thermal stress. Breakage at this point can result in loss of part of the ring and thus insufficient sealing material is left to fill the outer annulus. This design also results in the two sealing rings melting at different times because of temperature variations during sealing. To achieve more uniform melting of seal material, sealing rings of different materials having different melting points have been used. This has the disadvantage of requiring preparation and handling of two materials with different chemical formulations, which adds cost to a manufacturing process.

Another problem frequently encountered with the existing hat seal design relates to proper seating of the hat during sealing. As can be observed in FIG. 1*b*, prior to melting of the outer seal material ring 14, the hat button is lifted off the arc tube by the thickness of the seal material ring 14. During sealing, the button must seat down into the arc tube as the seal material melts. It is possible for the hat button to tip slightly as the seal material melts and not achieve the proper seating, especially if the arc tube-to-button tolerances are too close.

The disk seal design, shown in FIG. 1*c*, has the advantage of needing only one sealing material ring 17. The disk seal design, however, has decreased sealing reliability and increased tolerance control between the disk 18 and the tube 19. The disk seal utilizes a first cross-wire 7 which prevents the disk from falling off the electrode assembly. A second cross-wire 8 keeps the disk from falling into the tube and also provides a means of capillary transport of sealing material to both the inner and outer seal regions. See, for example, U.S. Pat. No. 4,034,252 issued to McVey on July 5, 1977. One problem with this construction is that if the delicate cross-wire is accidentally bent before or during assembly, the capillary action will be decreased or stopped entirely thereby resulting in incomplete filling of the outer annulus. The flow of sealing material into the outer annulus is also dependent on the width of the annulus. If it is too large, sealing material will reach the inner edge of the annulus, but not be able to bridge the gap because the cross-wire provides no capillary action across the gap. Another problem with this design relates to centering alignment of the electrode within the arc tube.

Examples of configurations used for the second cross-wire are illustrated in FIGS. 2 (*a–c*). The simplest cross-wire design, shown in FIG. 2*a*, provides only two points of contact 21, 22 between the disk 23 and the single support wire 24 which leaves the disk prone to rock.

Further modifications of the cross-wire configuration, such as the configurations shown in FIGS. 2*b*–2*c*, provide more stability but result in more complex parts assembly. FIG. 2*b* illustrates a dual wire configuration which employs two cross-wires 27, 28 for supporting the disk 23. The two cross-wires 27, 28 pass on opposite sides of the electrical feedthrough aperture 26. FIG. 2*c* illustrates a "hair pin" configuration. The "hair pin" configuration employs a single wire 29 which extends across the disk to one side of the electrical feedthrough aperture 26. The wire 29 is then bent to form a rounded or looped portion; the wire then extends back across the disk 23, passing the opposite side of the electrical feedthrough aperture 26. Again, the disk seal design shown in FIG. 1*c* requires an inner cross-wire or bend configuration to prevent the disk from sliding down on the feed-through.

Many of the aforesaid problems associated with existing seal designs result during the sealing operation. Failure to achieve the proper seal results in the loss of an arc tube as well as one or two costly electrode assemblies.

SUMMARY OF THE INVENTION

In accordance with one aspect of the present invention there is provided a seal button for a tubular arc tube, the arc tube having an inside diameter and outside diameter. The seal button comprises a first circular portion having a diameter approximately equal to the outside diameter of the arc tube, the first circular portion having a groove extending across the diameter of the first circular portion, the groove having a depth greater than or approximately equal to the thickness of the first circular portion; and a second circular portion concentric with and extending from the first circular portion, the second circular portion having a diameter of appropriate length for being inserted into an end of the arc tube; the seal button having an opening extending axially through the approximate center thereof, the opening being configured for receiving the electrical feedthrough portion of an electrode assembly.

In accordance with another aspect of the present invention there is provided a metal vapor arc discharge lamp comprising: an outer glass envelope having electrical conductors sealed therein and passing therethrough; an arc tube disposed within the outer glass envelope, the arc tube comprising the ??? a tubular ceramic arc tube envelope; a chemical fill within the arc tube envelope: having an opening therethrough for receiving an electrode assembly, a seal button at each end of the envelope, at least one seal button comprising a first circular portion having a diameter approximately equal to the outside diameter of the arc tube, the first circular portion having a groove extending across the diameter of the first circular portion, the groove having a depth greater than or approximately equal to the thickness of the first circular portion; and a second circular portion concentric with and extending from the first circular portion, the second circular portion having a diameter of appropriate length for being inserted into an end of the arc tube, the seal button having an opening extending axially through the approximate center thereof, the opening being configured for receiving the electrical feedthrough portion of an electrode assembly disposed at each end of the envelope, the electrode assembly including an electrical feedthrough portion with an electrode disposed at one end thereof, the electrical feedthrough portion passing through the seal button opening and being positioned such that the electrode projects into the tubular ceramic arc tube envelope; and seal means at each end of the envelope, the seal means sealing the seal buttons into the ends of the arc tube envelope and sealing the electrode assemblies into the seal button openings, each of the electrodes being in electrical connection with an electrical conductor; and means for electrically connecting the metal vapor arc discharge lamp to a power source.

In accordance with still another aspect of the present invention there is provided a sealing structure for an arc tube of a metal vapor arc discharge lamp comprising, prior to sealing, a seal button comprising a first circular portion having a diameter approximately equal to the outside diameter of the arc tube, the first circular portion having a groove extending across the diameter of the first circular portion, the groove having a depth greater than or approximately equal to the thickness of the first circular portion; and a second circular portion concentric with and extending from the first circular portion, the second circular portion having a diameter of appropriate length for being inserted into an end of the arc tube; the seal button having an opening extending axially through the approximate center thereof, the opening being configured for receiving the electrical feedthrough portion of an electrode assembly, an electrode assembly including an electrical feedthrough portion with an electrode disposed at one end thereof, the electrical feedthrough portion of the electrode assembly being positioned in the seal button opening such that the electrode projects from the second circular portion of the seal button; and frit material disposed upon the first circular portion of the seal button, the seal material surrounding the seal button opening through which the end of the electrode assembly opposite the electrode projects.

In accordance with yet another aspect of the present invention there is provided a method for sealing a seal button and electrode assembly into the end of an arc tube envelope of a metal vapor arc discharge lamp. The method comprises positioning into an end of the arc tube a sealing structure in accordance with the present invention; heating the outside region of the arc tube envelope adjacent the positioned seal button to a temperature sufficient to create a thermal driving force for drawing the seal material, as it melts, into the groove in the seal button, around the second circular portion of the seal button between the second circular portion and adjacent portion of the arc tube, and around the electrical feedthrough portion of the electrode assembly located within the opening in the seal button.

For a better understanding of the present invention, together with other and further objects, advantages, and capabilities thereof, reference is made to the following disclosure and appended claims in connection with the above described drawings.

DETAILED DESCRIPTION

Figure 1A:
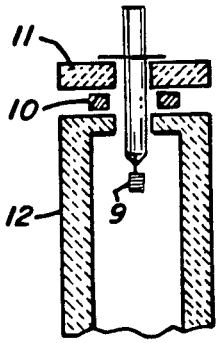
FIGS. 1*a, b,* and *c* illustrate a cross-section of various conventional seal structures, prior to sealing, used in sealing arc tubes for metal vapor arc discharge lamps.
Figure 1B:
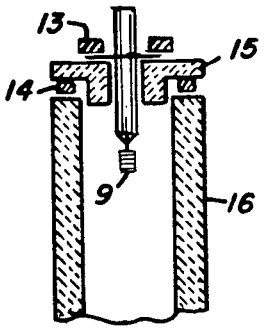
Figure 1C:
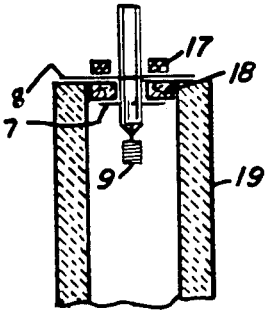
Figure 2A:
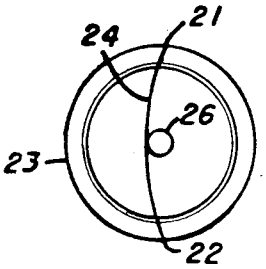
FIGS. 2*a, b,* and *c* illustrate a top view of various cross-wire configurations used with a disk seal structure.
Figure 2B:
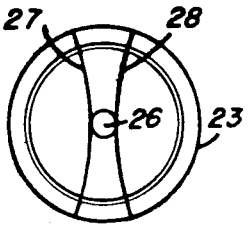
Figure 2C:
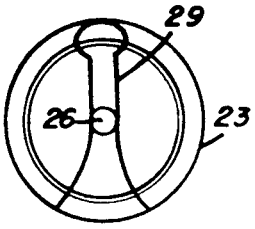
Figure 3D:
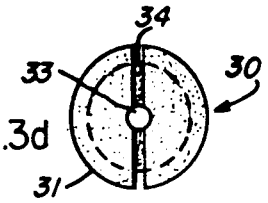
FIG. 3*d* illustrates a top view of a seal button in accordance with the present invention.
Figure 3A:
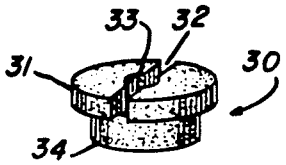
FIG. 3*a* illustrates an isometric view of a seal button in accordance with the present invention.

The seal button, seal structure, and method of the present invention eliminate many of the problems associated with the various seal designs heretofore used in sealing arc tubes of metal vapor arc discharge lamps. A preferred embodiment of the seal button of the present invention (also referred to herein as the "grooved-hat seal button") is illustrated in FIGS. 3*a–d.* FIG. 3*a* illustrates an isometric view of a preferred embodiment of the seal button of the present invention. The seal button 30 has a first circular portion 31 and a second circular portion 34 concentric with and extending from the first circular portion 31. The first circular portion 31 has a larger diameter than the second circular portion. The first circular portion 31 has a diameter approximately equal to the outside diameter of the arc tube envelope. The second circular portion 34 has a diameter of appropriate dimension for being positioned or fitted into the arc tube.

The diameter of the second circular portion is selected such that a space or gap exists between the inside wall of the arc tube envelope and the circumference of the second circular portion of the seal button. The space or gap receives seal material to seal the seal button into the arc tube envelope. Preferably the width of the gap is approximately equal around the circumference of the seal button, i.e., preferably the second circular portion of the seal button is approximately centered in the end of the arc tube.

The exact width of the gap is not critical. However, as the width of the gap increases, additional amounts of seal material are required to effect a seal between the arc tube wall and the seal button.

A difference of at least 0.004 inch between the diameter of the second circular portion of the seal button and the inside diameter of the arc tube envelope provides a sufficient gap for formation of a satisfactory seal. Preferably, such difference is from about 0.004 to about 0.008 inch, and most preferably from about 0.004 to about 0.006 inch.

The seal button 31 has an opening, or aperture, 33 which extends axially through the approximate center of the seal button. The opening 30 is of sufficient size and shape to accommodate the electrical feedthrough portion of an electrode assembly. A tube or wire feedthrough are examples of electrical feedthroughs typically used in an electrode assembly. The opening preferably has a round configuration.

The first circular portion 31 of the seal button 30 has a groove 32 extending across the diameter of the first circular portion. The groove 32 has a depth which is at least equal to the approximate thickness of the first circular member 31. In other words, the groove extends completely through the first circular portion of the seal button and may further extend into the second circular portion. The groove should not be so deep that the seal button would fracture during handling. Preferably, the depth of the groove is equal to the thickness of the first circular portion of the seal button.

The width of the grove is sufficient to create capillary pull, or draw, of melted seal material across the space or gap between the second circular portion of the seal button and the arc tube envelope wall during sealing. The width of the groove 32 is preferably less than the diameter of the aperture 33, as is shown in FIG. 3*a*. In a most preferred embodiment the groove has a width of about 0.007 to about 0.010 inch.

Figure 3B:
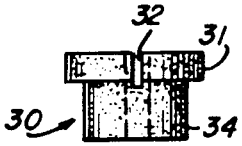
FIGS. 3*b* and *c* illustrate side views of a seal button in accordance with the present invention.
Figure 3C:
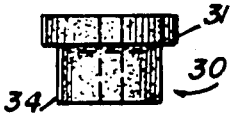

FIGS. 3*b* and 3*c* illustrate side views of the present seal button 30. FIG. 3*b* illustrates a side view of the seal button 30, showing the groove 32 having a depth approximately equal to the thickness of the first circular portion. The groove 32 exposes a diametric portion of the second circular member 34; this is more easily seen in FIG. 3*d*.

FIG. 3*c* illustrates a side view of the seal button, the view showing the seal button shown in FIG. 3*b* rotated 90°. The seal button of the present invention advantageously can be used with the lower cost straight arc tube thereby providing a less expensive construction than the monolithic arc tube design. The present invention is particularly advantageous when utilized in metal vapor arc discharge lamps such as a high pressure sodium lamp.

Figure 4A:
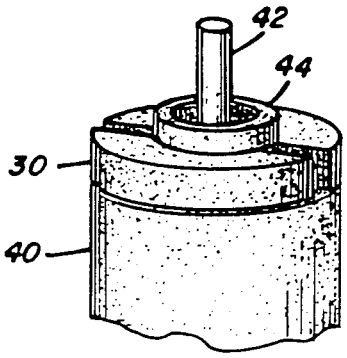
FIG. 4*a* illustrates a seal structure in accordance with the present invention prior to sealing.
Figure 4B:
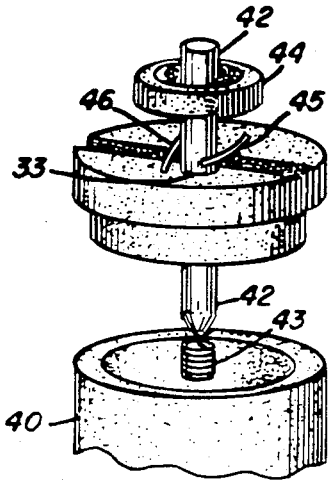
FIG. 4*b* illustrates an exploded view of a seal structure in accordance with the present invention prior to sealing.

The pre-seal schematic assembly of a preferred embodiment is illustrated in FIGS. 4*a* and 4*b*. As shown in FIG. 4*a* the first circular portion of the grooved-hat button 30 rests directly on the arc tube 40. A ring of seal material 44 is positioned around the electrical feedthrough portion 42 of the electrode electrical feedthrough portion 42 of the electrode assembly. The button and electrode are already in their final positions and no additional seating need occur during sealing. Therefore, the possibilities of tipping or not dropping into place are eliminated. The electrode assembly, having a tube feedthrough portion, is prevented from dropping into the tube by use of back-space wires.

Referring to FIG. 4*b*, there is shown an exploded view of a seal structure assembly in accordance with the present invention. The electrode assembly shown in FIG. 46 comprises a niobium electrical feedthrough tube 42 connected to a shank which supports an electrode 43. The electrode assembly is inserted into the opening 33 which extends axially through the seal button. Backspace wires 45, 46 prevent the electrode assembly from dropping into the arc tube envelope. The electrode 43 extends into the arc tube 40. One ring of seal material 44 is then placed over the feed-through 42. The dimensional tolerances for this seal material ring are not critical so it can be sized to withstand rough handling and easy placement over the feed-through.

In the case of a wire feed-through, a slight crimp in the wire at the desired back-space distance has been found to be satisfactory. This crimp also has the advantage of eliminating back-space wires and their associated welding operation.

When the seal is made, heat is applied to outer surface of the arc tube adjacent the seal area. The sealing temperature is related to the melting point of the particular seal material used. Temperatures of from about 1400°–1650° C. have been found to be suitable sealing temperatures for use with the seal materials used. By heating the outer area of the arc tube first, a thermal driving force draws the seal material, as it melts, to the outer seal region. As the seal material melts, it flows into the groove in the hat and is drawn to both inner and outer seal regions by capillary action. The seal material will flow across the outer annulus by using the groove in the seal button as a capillary bridge. Once the annulus is bridged with seal material, capillary flow around this now hotter annulus occurs rapidly and smoothly. The tolerances for the annulus gap are not as critical as for cross-wire construction because the groove through the first circular portion of the seal button will easily provide bridging in cases where the cross-wire will not. The groove advantageously provides uniform flow of seal material to both inner and outer seals using only one seal material ring. The flow of seal material is found to occur in a more reliable manner than with the two seal material rings used in the existing hat seal design.

The difficulties which arise from misalignment due to tipping or rocking of the disk seal are minimized with the seal structure of the present invention. The present seal button makes 360° contact with the arc tube thus providing a stable alignment. This alignment eliminates the need for special, more costly cross-wire configurations heretofore needed to achieve stable alignment.

An additional advantage of this design is the elimination of a possible electrolysis path across the seal. A voltage potential exists between the end of the arc tube and the electrode. In the cross-wire design, the cross-wire on the outside of the arc tube is electrically connected to the electrode and thus at the same electrical potential. The same electrical potential also extends across the outer seal region, thereby creating a situation where an electrical potential can be established across the seal (i.e., the cross-wire on external side of seal is at a different potential than the arc tube on the internal side of the seal). Since movement of cations such as sodium is known to be accelerated by an electrical potential, this could result in increased movement of the cations into the seal in this region. The grooved-hat seal structure of the present invention eliminates the need for the cross-wire and thereby eliminates this potential problem.

Figure 5:
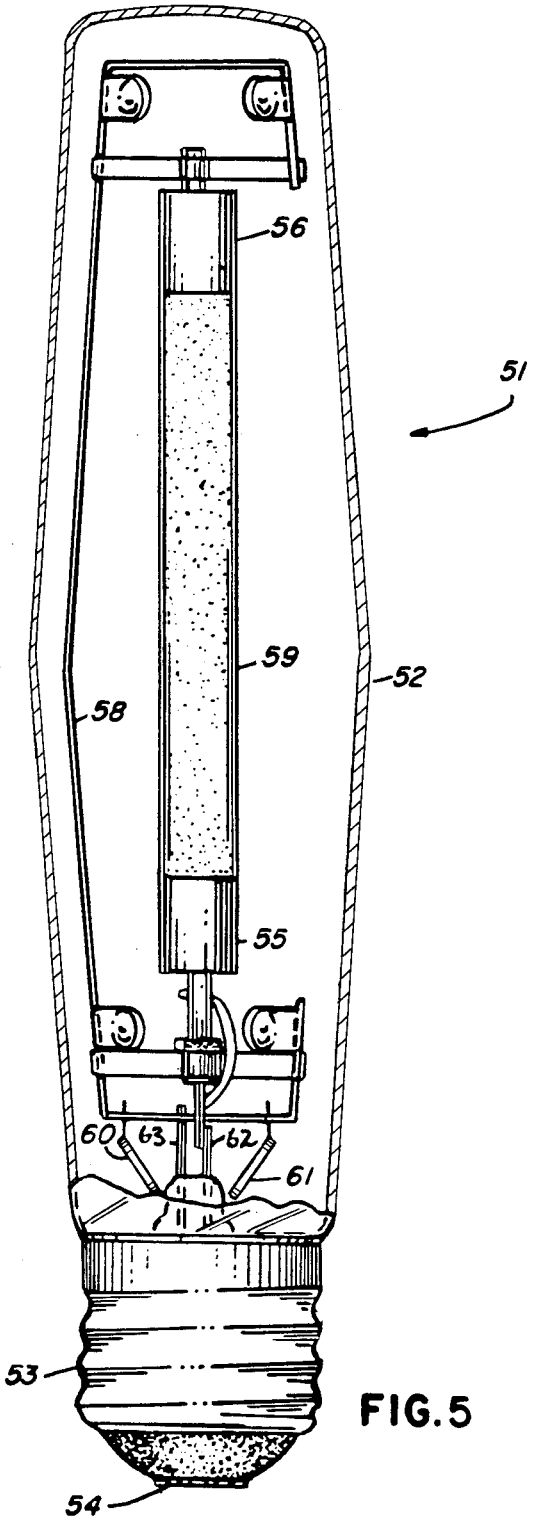
FIG. 5 illustrates an example of the structure of a high pressure sodium vapor discharge lamp.

FIG. 5 illustrates an example of a high pressure sodium vapor discharge lamp to which the invention is applicable. The lamp 51 comprises an arc tube 59 supported within an evacuated outer vitreous glass envelope 52, for example, borosilicate glass, having means for electrically coupling the lamp with a power source (not shown), such as a lamp base 53 with a terminal 54. Electrical conductors 62, 63 are sealed within and pass through the outer envelope to provide electrical connections from the interior to the exterior of the glass envelope. The arc tube 59 containing a fill comprising sodium, mercury, and a rare gas is supported within the outer envelope 52 by support means 58 such as a metallic frame in a well known manner. The rare gas acts as a starting gas and the mercury acts as a buffer gas to raise the gas pressure and operating voltage of the lamp to a practical level. Heat conserving elements 55, 56, may be wrapped about the arc tube 59 at each end thereof in the vicinity of the electrodes (not shown), in order to reduce the heat differential thereat from the center of the arc tube.

Each end of the arc tube is sealed with a seal structure in accordance with the present invention. The seal is formed from seal means comprising fused seal material, such as melted (or fused) glass ceramic frit which seals the electrode assembly into a seal button in accordance with the present invention and which further seals the seal button into the end of arc tube.

The seal material can be any of the seal materials typically used in the fabrication of arc tubes for high pressure sodium vapor discharge lamps, such as, for example, an alkaline-earth based seal material including $A1_2O_3$, CaO and BaO with replacements or additions of SrO, $Y_2O_3$, $La_2O_3$, MgO, and/or $B_2O_3$.

The typically used seal materials, however, experience some reaction with the sodium component of the fill. The reaction of these seal materials with the sodium results in degradation of the seal, particularly at the outer seal region. Preferably, a less sodium reactive seal material is used, such as, for example rare-earth based materials including alumina as a major component and further including $Sc_2O_3$, $Y_2O_3$, and/or $La_2O_3$.

A high pressure sodium discharge lamp in accordance with the present invention may be of a saturated or unsaturated vapor type. The amounts of sodium and mercury required to dose either saturated or unsaturated type high pressure sodium lamps are known to those skilled in the art.

The arc tube comprises translucent ceramic such as polycrystalline alumina. The arc tube may further comprise dopants such as yttria, magnesia, and/or lanthana. The seal button comprises a ceramic material such as, for example, polycrystalline alumina. The seal button may further comprise dopants such as yttria, magnesia, and/or lanthana.

Most high pressure sodium discharge lamps can operate in any position. The burning position has no significant effect on light outputs. A high pressure sodium discharge lamp may further include diffuse coatings on the inside of the outer bulb to increase source luminous size or reduce source luminance. The outer envelope may further include getters, 60, 61.

In summary, a metal vapor arc discharge lamp, seal button, and seal structure has been provided and found to have distinct advantages over other heretofore existing designs. This novel seal structure has significantly reduced or eliminated many of the drawbacks of existing constructions resulting in less expensive, simpler, and more reliable sealing of metal vapor arc tubes.

While there has been shown and described what are considered preferred embodiments of the present invention, it will be obvious to those skilled in the art that various changes and modifications may be made therein without departing from the invention as defined by the appended claims.

What is claimed is:

1. A seal button for arc tube, said arc tube comprising a tubular envelope having an inside diameter and an outside diameter, said seal button comprising:

a first circular portion having a diameter approximately equal to the outside diameter of the arc tube, said first circular portion having a groove extending across said diameter of said first circular portion, said groove having a depth greater than or approximately equal to the thickness of said first circular portion; and a second circular portion concentric with and extending from said first circular portion, said second circular portion having a diameter of appropriate length for being inserted into an end of the arc tube;

said seal button having an opening extending axially through the approximate center thereof, said opening being configured for receiving the electrical feedthrough portion of an electrode assembly.

2. A seal button in accordance with claim 1 wherein said seal button comprises a ceramic material.

3. A seal button in accordance with claim 2 wherein said ceramic material comprises polycrystalline alumina.

4. A metal vapor arc discharge lamp comprising:

an outer glass envelope having electrical conductors sealed therein and passing therethrough;

an arc tube disposed within said outer glass envelope, said arc tube comprising a tubular ceramic arc tube envelope;

a chemical fill within said arc tube envelope, a seal button having an opening therethrough for receiving an electrode assembly at each end of said envelope, at least one seal button comprising a first circular portion having a groove extending across said diameter of said first circular portion, said groove having a depth greater than or approximately equal to the thickness of said first circular portion, and a second circular portion concentric with and extending from said first circular portion, said second circular portion having a diameter of appropriate length for being inserted into an end of the arc tube, said seal button having an opening extending axially through the approximate center thereof, said opening being configured for receiving the electrical feedthrough portion of an electrode assembly;

an electrode assembly havng an electrode at one end thereof disposed at each end of the envelope, said electrode assembly passing through said seal button aperture and being positioned such that the electrode projects into said tubular ceramic arc tube envelope; and seal means at each end of said envelope, said seal means sealing said seal buttons into the ends of said arc tube envelope and sealing said electrode assemblies into the seal button openings, each of said electrodes being in electrical connection with an electrical conductor.

5. A metal vapor arc discharge lamp in accordance with claim 4 wherein said seal means comprises a fused glass ceramic frit.

6. A metal vapor arc discharge lamp in accordance with claim 5 wherein said chemical fill comprises sodium, mercury and a rare gas.

7. A metal vapor arc discharge lamp in accordance with claim 6 wherein said lamp is an unsaturated vapor type high pressure sodium lamp.

8. A metal vapor arc discharge lamp in accordance with claim 6 wherein said lamp is a saturated vapor type high pressure sodium lamp.

9. A sealing structure for an arc tube of a metal vapor arc discharge lamp comprising, prior to sealing:

a seal button comprising a first circular portion having a diameter approximately equal to the outside diameter of the arc tube, said first circular portion having a groove extending across said diameter of said first circular portion, said groove having a depth greater than or approximately equal to the thickness of said first circular portion, and a second circular portion concentric with and extending from said first circular portion, said second circular portion having a diameter of appropriate length for being inserted and sealed into an end of the arc tube, said seal button having an opening extending axially through the approximate center thereof, said opening being configured for receiving the electrical feedthrough portion of an electrode assembly;

an electrode assembly including an electrical feedthrough portion with an electrode at one end thereof, said electrode assembly being positioned in the seal button opening such that said electrode projects from said second circular portion of said seal button; and seal material disposed upon the first circular portion of said seal button, said frit material surrounding the seal button opening through which the end of the electrode assembly opposite electrode projects.

10. A method for sealing a seal button and electrode assembly into an end of an arc tube of a metal vapor arc discharge lamp comprising:

positioning into an end of the arc tube a sealing structure in accordance with claim 9;

heating the outside region of the arc tube envelope adjacent the positioned seal button to a temperature sufficiently high to melt the seal material in order to create a thermal driving force for drawing the melting seal material into the groove in the seal button, around the second circular portion of the seal button between the second circular portion and adjacent portion of the arc tube, and around the portion of electrode assembly located within the aperture in the seal opening.

* * * * *

UNITED STATES PATENT AND TRADEMARK OFFICE

CERTIFICATE OF CORRECTION

PATENT NO. : 4,713,580

DATED : December 15, 1987

INVENTOR(S) : Carl M. Schoene

It is certified that error appears in the above—identified patent and that said Letters Patent is hereby corrected as shown below:

Column 3, line 8 -- please delete "the ???".

Signed and Sealed this

Twenty-seventh Day of September, 1988

*Attest:*

DONALD J. QUIGG

*Attesting Officer*

*Commissioner of Patents and Trademarks*